United States Patent [19]

Beymer et al.

[11] Patent Number: 4,953,815

[45] Date of Patent: Sep. 4, 1990

[54] FOLDABLE RACK FOR POSITIONING A PLASTIC BAG AS A RECEPTACLE AND FOR SPARE BAG STORAGE

[76] Inventors: Norman Beymer, P.O. Box 126714, San Diego, Calif. 92112-6714; Gary W. Kite, 422 Wolford Dr., Spring Valley, Calif. 92077

[21] Appl. No.: 447,041

[22] Filed: Dec. 7, 1989

[51] Int. Cl.[5] ..... B65B 67/12

[52] U.S. Cl. ..... 248/97

[58] Field of Search ..... 248/95, 97, 99, 100, 248/101, 150, 153, 175; D34/5, 6; 220/9.3, 404; 280/641, 651

[56] References Cited

U.S. PATENT DOCUMENTS

| | | | |
|---|---|---|---|
| 334,674 | 1/1886 | Neal | 220/9.3 |
| 2,875,806 | 3/1959 | Block | 248/150 |
| 3,502,291 | 3/1970 | Ackerman | 248/164 |
| 3,633,932 | 1/1972 | Holden | 280/641 |
| 3,659,816 | 5/1972 | Wilson | 248/175 |
| 4,055,357 | 10/1977 | Sorocin | 280/641 |
| 4,318,520 | 3/1982 | Walker | 248/99 |
| 4,593,873 | 6/1986 | Nelson | 248/99 |
| 4,613,104 | 9/1986 | Garrott | 248/97 |
| 4,723,741 | 2/1988 | Doering | 248/97 |
| 4,793,628 | 12/1988 | Haley, Sr. | 280/641 |

*Primary Examiner*—Ramon O. Ramirez
*Assistant Examiner*—Robert A. Olson
*Attorney, Agent, or Firm*—Frank D. Gilliam

[57] ABSTRACT

A foldable formed wire rack for positioning and supporting conventional pliable plastic bags with handle openings for use as a receptacle for trash or the like and for storing a quantity of pliable plastic bags thereon for future use. The rack is formed of galvanized wire bent to form a side thereof and then butt welded together at the ends to form a closed loop. The sides are additionally formed to pivotly interlock together along their longest dimension by a central offset jog along one of their smaller dimension surfaces, hereinafter referred to as the top for accepting the normal handle openings of the bag. The wire is then coated with a finish such as a coating of plastic powder then baked, electrostaticly painted or the like. A vertical support member connects to the tops of the sides and one of the pivotal connections to hold the sides to prevent pivoting when supporting a bag therebetween, acts has a handle for transporting the device, a support for unused bags for future use and a holder for a dampened sponge to moisten the fingers of a person grasping a new bag for use on the device to prevent the fingers from slipping.

7 Claims, 1 Drawing Sheet

FOLDABLE RACK FOR POSITIONING A PLASTIC BAG AS A RECEPTACLE AND FOR SPARE BAG STORAGE

BACKGROUND OF THE INVENTION

The invention is directed to a support rack for pliable plastic bags and more particularly to a plastic trash bag holder formed from a pair of wire sides that are foldable together for storage and deplorable apart to a rack use position for supporting a pliable plastic bag as a receptacle and storing additional folded pliable plastic bags for future use thereon.

Other holders for a similar purpose and construction can be found in the following U.S. Pat. Nos.:

3,502,291;
3,659,816;
4,593,873;
4,613,104; and
4,723,741.

The last four above referenced patents employ wire sides which interlock in various manners to form an upright support for a pliable bag. The collapsible stand set forth in U.S. Pat. No. 3,659,816 by inventor James D. Wilson teaches a self-supporting collapsible stand for supporting pliable plastic bags, laundry bags or the like. The stand of the teaching is formed of a pair of essentially rectangular wire-formed loops which extend transversely to one another on a pivotal X-like relationship. The sides of one of the wire loops have respective intermediate S-shaped portions therein, and the sides of the other loop having respective U-shaped portions therein and intersecting the aforementioned S-shaped portions of the first wire loop to form a stop for the loops and limit the maximum allowable angular movement therebetween. The teaching of this reference is limited in the fact that the stop formed by the combined S and U shaped bends in the sides of the loops has only one stop position, i.e. an extreme open position, and cannot be locked in place to support various sized bags or locked against folding to a closed position. If smaller bags are used the material of the bag is required to provided the necessary stop to prevent the sides of the stand from seeking the normal stop formed by the S and U bends. No provision is made in this device for supporting and storing unused bags for future use, handles for attaching the normal handle openings found in pliable shopping bags or support means for any bags which are co-planar with the sides of the stand.

U.S. Pat. No. 4,593,873 teaches a device similar to the last mentioned device and additionally includes a lid that can be actuated by a foot pedal. The side supports have an S and U shaped interconnects as mentioned above.

U.S. Pat. Nos. 4,613,104 and 4,723,741 teach foldable rack support devices the sides of which are interconnected for pivoting by external connectors.

There is a continuing need for an improved support means for pliable plastic bags especially the reuse of those pliable plastic bags with open handle access areas which a large number of grocery and other stores supply to purchasers of products to contain those goods until the purchaser reaches home. The recycle of these bags for the use as trash bags or the like provides a saving both economically to the buying public and a benefit to the ecology.

SUMMARY OF THE INVENTION

The invention is directed to an improved wire constructed pliable plastic bag support for holding the bag open for use as a receptacle for filling with goods, trash or the like.

The support is formed from a pair of closed loop sides constructed of stiff wire coated with a smooth surface medium which interconnect along their vertical sides by means of S configured bends that are angled between 40 and 50 degrees from the plane of the loop. It is found that an angle of substantially 45 degrees is ideal. The interlocking of the angled S bends reversely positioned allow the closed loop sides to reach a maximum spread apart deployed use position substantially in the form of an X. The upper ends of the closed loops jog inward and upward from their normal rectangular configuration to form coplanar rectangular ends resembling handles. These rectangular ends receive the handle openings found in pliable plastic bags used by stores or the like to package goods for buyers to transport the goods. The openings in the bags are placed over the ends of the loops to support the bag in substantially a maximum open position so that they can be readily filled as required and then when filled to their desired capacity can be readily removed from the rack.

To prevent the undesirable collapse of the rack while supporting a bag, a cruciform locking means having two legs is employed. One of the legs is attached between the two opposing sides, i.e. across the X. The other leg has an approximately C shaped hook on one end thereof for insertion into the topmost loop of the figure eight formed by the adjacent interlocked S bends to hold the locking means in place and a ring on the other end for receiving an opening through a plurality of folded pliable bags for storage of those bags on the rack, as a handle for transporting the rack and bags thereon and the holding of a moistened sponge for cleaning the oil from the fingers of the user for easy separation of a bag from the plurality of bags in storage for use on the holder. The position of the angled S shaped bends on the closed loops determines how far the top of the loops pivot away from each other in their fully deployed or use position, i.e. the maximum bag opening. The S bends are shown located below the center of the vertical sides to provide a larger spread between the top of the loops than the bottom of the loops to insure that the rack has a minimum vertical profile while the bag carried thereby is in a maximum open condition and the loop base support is centered generally below the center of the contents of the bag for stability. It should be understood that the position of the loops can be selectively chosen to accommodate different size bag openings.

An object of this invention is to provide a fold up wire rack for pliable plastic bags or the like which can accommodate the handle openings of the bag for support thereon.

Another object of the invention is to provide a locking means for locking the legs of the wire rack in a use position from either collapsing or closing.

Still another object of the invention is to provide a fold up wire rack for pliable bags or the like that includes a means for storing one or more pliable plastic bags or the like for future receptacle use on the wire rack.

These and other more specific objects of the invention will appear upon reading the following specifications and claims and upon considering in connection therewith the attached drawings to which they relate.

BRIEF DESCRIPTION OF THE DRAWING FIGURES

Referring now to the drawings in which a preferred embodiment of the invention is illustrated:

DESCRIPTION OF THE PREFERRED EMBODIMENT

Figure 1:
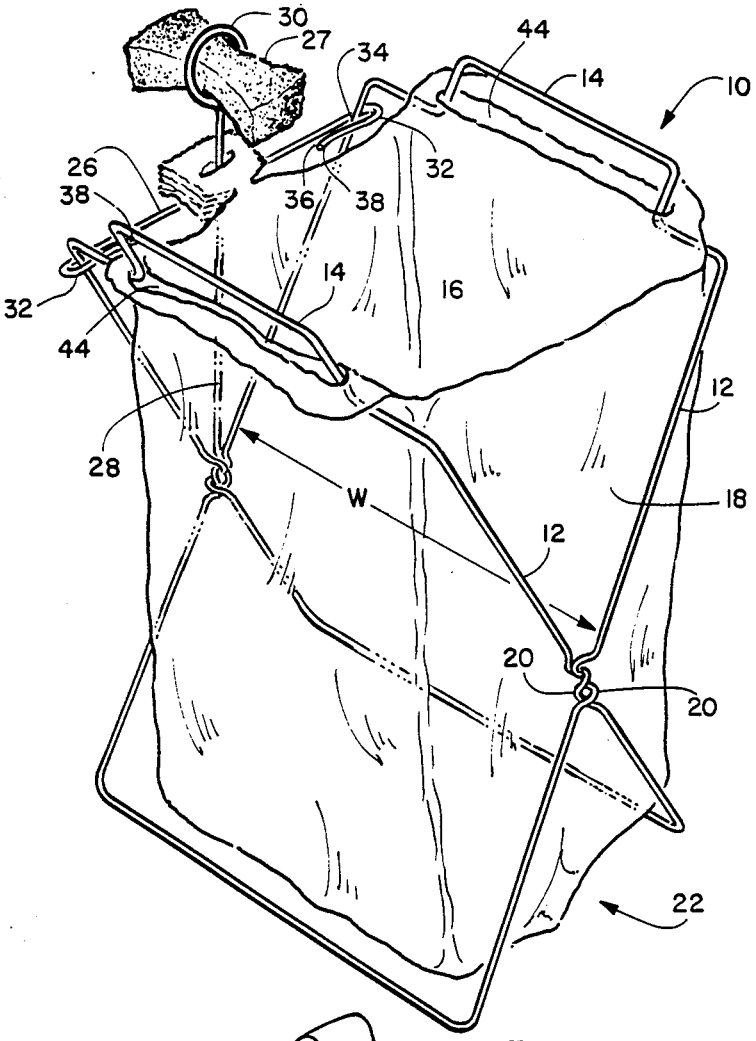
FIG. 1 is a perspective showing of the rack in its use position with a phantom showing of a translucent pliable bag in position as a receptacle.
Figure 4:
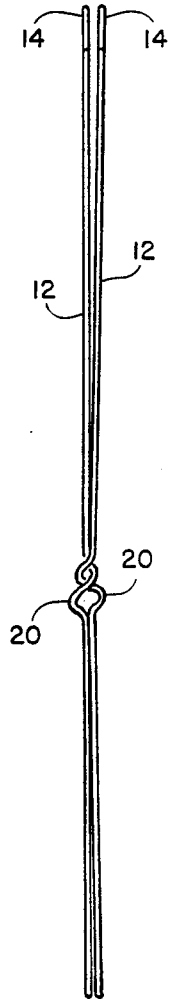
FIG. 4 is a side view showing of the rack in a folded stowed condition.

Referring now to the various drawing Figures. FIG. 1 is a perspective showing of the rack 10 of the invention in a deployed use position. The rack 10 is formed by two substantially identical loops 12 formed from resilient stiff wire or the like coated to form a smooth outer surface. Positioned at one end of the loops, hereinafter referred to as the top, is a centrally positioned coplanar offset or jog 14 of a dimension smaller than the overall width W of the loop designed to receive the opening 16 in a pliable bag 18 for its support hereinafter discussed in more detail. Intermediate the longest dimensions of the loops 12, herein after referred to as the vertical sides, is an S configured bend 20. When the two S bends off the loops are interconnected with one in a reverse direction to the other the rack assembly 10 is formed. The interconnecting of the two S bends in this manner allows the sides of the rack to be locked together and yet pivot between the FIG. 1 deployed or use position and FIG. 4 position stowed or stored position.

As can be seen in FIG. 1, the S bends are not coplanar with the wire loops. The S bends 20 are formed at an angle to the plane of the loops. This angle is between forty and fifty degrees. An angle of forty-five degrees is ideal. This angled offset of the S determines the range of pivoting between the loops.

The S bends are located below vertical center of the vertical loops 12, as shown in FIG. 1, to allow the top portion of the loops, jog 14, to effectively extend further than the bottom or support portion 22 of the rack. This allows the bag 18 to be spread completely open at the top, center the contents of the bag on the bottom rack and reduce the overall vertical height of the rack 10 when in use as shown in FIG. 1.

Figure 2:
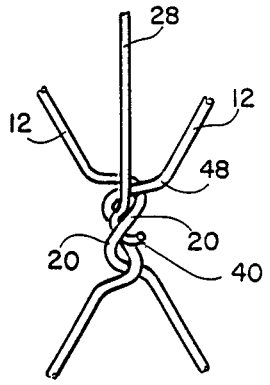
FIG. 2 is an enlarged showing of the angled S interlock of the support loops.
Figure 3:
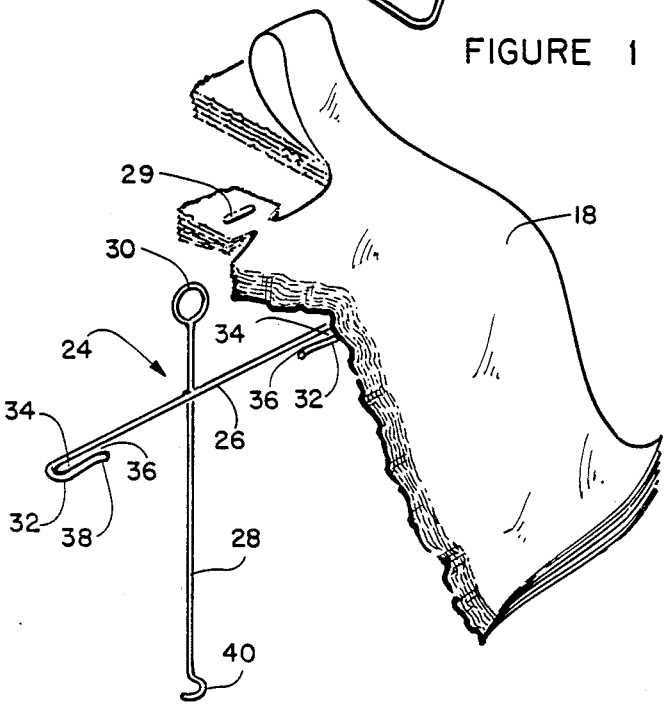
FIG. 3 is a showing of the rack deployed locking member with a looped top section for receiving a plurality of bags for future use storage.

As can be seen in FIG. 3, a cruciform shaped locking member 24 with arms 26 and 28 is shown. The locking member 24 has three purposes. The locking member holds the loops 12 in the FIG. 1 position, i.e. deployed or use position, has a circular opening 30 at the topmost end which when the rack is being transported acts as a carrying handle, receives the opening 29 from a plurality of pliable plastic bags 18 for storage on the rack and supports them for future use and is used for removeably holding a dampened sponge 27 so that the fingers of the user can be moistened to facilitate easy separation of one bag from the quantity of bags in storage. The locking member 24 is positioned as shown in FIG. 1 and includes folded back portion 32 on arm 26. This folded back portion forms a space 34 with the adjacent portion of arm 26. This space 34 narrows at the open end 36 of the folded back portion. The tip 38 of the folded back portion has a curvilinear shape which acts as a cam surface to force the open end 36 of the arm 26 to engage, flex open further against its resiliency and pass over the loops and spring back to its normal configuration when it passes over the sidewall of the loop as shown in FIG. 1. The end of arm 28 opposite the carrying handle 30 includes a C shaped tip 40 which when the locking member 24 is in the FIG. 1 position inserts and rests on the joined Ss, see FIG. 2. The locking member 24 is installed after the loops are pivoted apart and is removed when the loops are to be pivoted together for rack storage.

When in use the loops are pivoted to their FIG. 1 position, locked in position with the locking member 24, a plurality of bags 18 are positioned over the handle 30 for future use, one of the plurality of bags 18 is positioned on the rack as a receptacle by placing the elongated slits 44 located on each end of the bag over the jog 14 as shown in FIG. 1. When the bag is to be removed and another bag be positioned in its place in the same manner.

The locking member 24 as well as the loops 12 are formed of a stiff resilient material in the form of wire or the like.

Although throughout the discussion the bag 18 is described as a pliable plastic bag, any type pliable bag requiring a similar rack for support could be used on the rack 10 of the invention.

It will be appreciated, of course, that although a particular embodiment of the invention has been shown and described, modifications may be made. It is intended in the following claims to cover the modifications which come within the spirit and scope of the invention.

What is claimed is:

1. A rack for supporting pliable bags having an open top comprising:

a pair of rectangular formed closed wire loops, each of said loops having opposing S shaped bends angularly offset from the plane of said loops along opposite side thereof and a centrally positioned coplanar protuding rectangular ear formed on one end of each of said loops, when the S shaped bends are reversed one to the other they interlock said loops together in a pivotable fashion with said ears adjacently opposing each other;

a removable locking member for locking said closed loops in substantially a maximum pivoted apart position, said locking member having two fixedly positioned arms in a cruciform configuration with one arm having a C shaped end for resting in the interlocked S bends and an end having a combined bag storage support and handle, the other arm of said locking member having locking means on each end thereof for securing said loops in a relative spaced apart position; and a pliable bag with sits in adjacent sides thereof each of said slits being placed over one of said ears whereby said bag is supported in a substantially maximum top open condition for use as a receptacle.

2. The invention as defined in claim 1 wherein said opposing S shaped bends are angularly offset from the plane of said loops from between 40 and 50 degrees.

3. The invention as defined in claim 1 wherein said opposing S shaped bends are angularly offset from the plane of said loop substantially 45 degrees.

4. The invention as defined in claim 1 wherein said S shaped bends are vertically positioned along said loops in a selected location depending on the required degree of opening of the open top of said bag relative to its height.

5. The invention as defined in claim 1 wherein said locking means comprise the ends of said other arms folded back on themselves forming an open substantially U shaped portion with the open space between the sides of the U having the narrow portion adjacent said open end thereof whereby the narrow opening in each of said U shaped portions is forced over a separate one of said loops for locking therearound.

6. The invention as defined in claim 5 wherein the outer distal end of said U shaped portion is curvilinear and acts as a cam for increasing the width of said narrow portion when said narrow portion is forced over one of said loops.

7. The invention as defined in claim 1 wherein said bag support and handle further supports a dampened sponge.

* * * * *